United States Patent [19]

Garnett

[11] 4,435,924

[45] Mar. 13, 1984

[54] METHOD OF GRINDING WORKPIECES

[75] Inventor: Jack L. Garnett, Beloit, Wis.

[73] Assignee: The Bendix Corporation, Cleveland, Ohio

[21] Appl. No.: 431,513

[22] Filed: Sep. 30, 1982

Related U.S. Application Data

[62] Division of Ser. No. 206,122, Nov. 12, 1980, Pat. No. 4,368,595.

[51] Int. Cl.[3] ..... B24B 1/00

[52] U.S. Cl. ..... 51/327; 51/118

[58] Field of Search ..... 51/118, 215 R, 215 H, 51/215 HM, 218 CP, 327

[56] References Cited

U.S. PATENT DOCUMENTS

| | | | |
|---|---|---|---|
| 1,393,668 | 10/1971 | Cummings | 51/118 |
| 1,923,931 | 8/1933 | Jones | 51/118 |
| 2,864,209 | 12/1958 | Balsiger | 51/215 H |
| 2,990,659 | 7/1961 | Benkovich et al. | 51/118 |
| 3,800,476 | 4/1974 | Fallon | 51/118 |

*Primary Examiner*—Harold D. Whitehead
*Attorney, Agent, or Firm*—Kenneth A. Seaman

[57] ABSTRACT

An apparatus for and method of grinding workpieces (e.g., universal joint crosses) in which the workpieces are automatically loaded, later indexed, and later unloaded from a rotary carrier (20) by an improved workpiece handling accessory (40). The workpiece handling accessory includes a rotating plate member (42) which has several spaced apertures (47, 48, 49) for receiving and retaining workpieces therein. A workpiece (33) is moved from a queue to a load station where the workpiece is transferred to the rotary carrier (20) for a grinding of the first two legs. A workpiece (22) on which the first two legs have been ground is removed from a pocket (22) of the carrier indexed (rotated) by 90° by the plate member (20) and replaced in the same pocket (34) of the carrier (30) from which it had previously been removed so that the other two legs can be ground. A workpiece (35) on which all four legs have been ground is removed from the carrier and moved to a discharge chute (14) for completed parts.

8 Claims, 8 Drawing Figures

FIG. 7
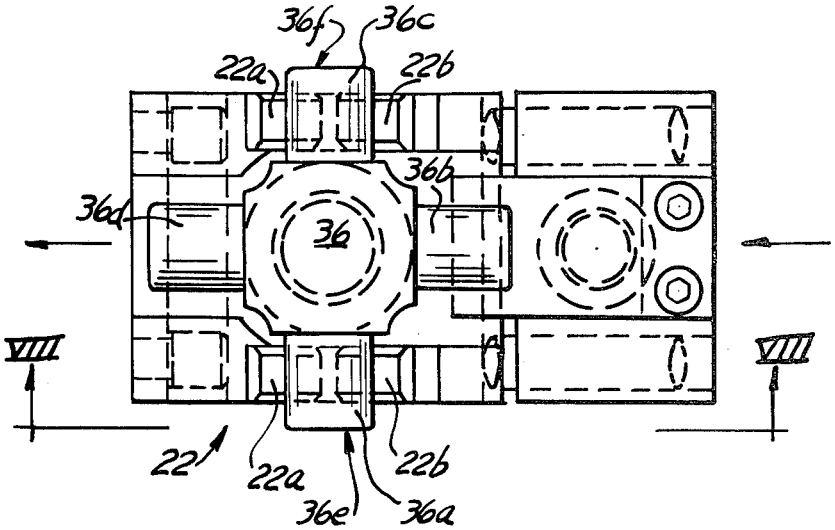
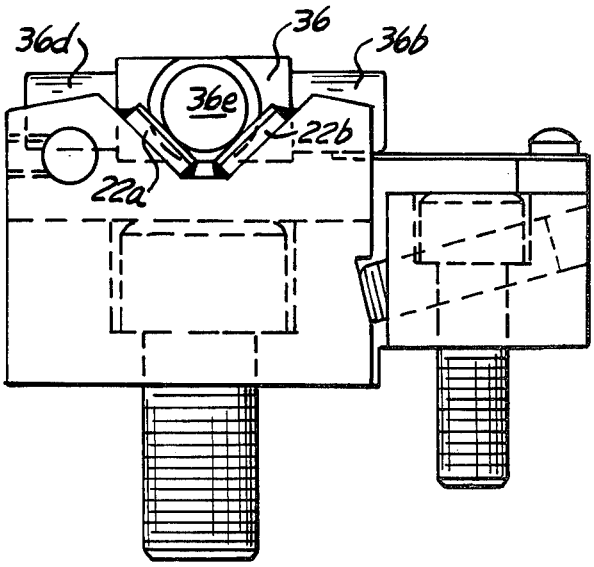
FIG.8

METHOD OF GRINDING WORKPIECES

This application is a division of application Ser. No. 206,122, filed Nov. 12, 1980, and now U.S. Pat. No. 4,368,595 issued Jan. 18, 1983.

TECHNICAL FIELD

The present invention relates to a method of grinding workpieces. More particularly, the present invention relates to a workpiece handling accessory (or system) for the grinding apparatus, in which a workpiece is loaded onto a carrier for grinding the one or two parallel surfaces, indexed or rotated after grinding one or two parallel surfaces to present one or two other surfaces for grinding, then, following the grinding of the other surfaces, the workpiece is unloaded and discharged from the apparatus. The handling accessory or system loads the workpiece into the carrier, later indexes the workpiece and, still later, unloads and discharges the finished workpiece automatically.

BACKGROUND ART

The present invention relates to a method of workpiece handling in a grinding apparatus of the type which is commonly referred to as a disc grinder, in which a workpiece is moved by a workpiece carrier into a grinding area where one or two parallel surfaces of the workpiece are ground by a surface of a disc which is fed along an axis of the disc into the workpiece.

Such a grinding apparatus is well known in the art. Bendix offers several models of horizontal single and double disc grinders in various sizes under its Bendix Besly trademark. Bendix also offers several vertical single and double disc grinders in various sizes. These disc grinders are especially suited for grinding a precisely located, smooth finish on a part, with a substantial parallelism between ground surfaces ground or finished by a double disc grinder. The horizontal and vertical appellations refer to the axis or direction in which the grinding disc is advanced and not the orientation of the grinding surface, which grinding surface is perpendicular to axis of disc advance. One such grinding apparatus is described in U.S. Pat. No. 3,800,476 of H. J. Fallon entitled "Rotary Work Carrier for a Double Disc Grinder," a patent which is hereby incorporated herein by reference, particularly for its disclosure of disc grinder structure and operation.

In the grinding of some workpieces, such as universal joint crosses, it is desirable to provide a finished or ground surface on four legs, i.e., two parallel surfaces at the ends of each of two intersecting or transverse legs (or arms) of the cross. Such workpieces are advantageously finished by grinding two parallel surfaces on alternate legs, then by rotating or indexing the workpiece by 90 degrees to present the other two unground surfaces on the intermediate legs in an orientation for grinding. After those other two surfaces are ground, the finished workiece is removed from the grinding apparatus.

One apparatus for grinding such workpieces is disclosed in U.S. Pat. No. 2,990,659 entitled "Work Indexing Means for Disc Grinders." Such an apparatus discloses a rather complicated workpiece handling apparatus for indexing (or rotating by 90°) the workpiece after machining a first set of parallel surfaces. However, such apparatus uses a manual (operator) loading and unloading of the workpiece carrier and does not teach or suggest an automatic loading or unloading of the workpiece carrier. The described apparatus does eliminate the need for the operator to select and manually remove a workpiece and rotate it by hand and replace it. But such workpiece indexing is only one part of the manual labor involved in grinding such crosses.

Previous to the grinding apparatus described in the above patent, cross grinding relied upon an operator's selecting or sorting of partially ground workpieces which the operator then manually indexed and replaced in the carrier. The operator also loaded manually the unground workpieces as well as unloaded the completely ground parts. Such a system is slow, labor intensive, costly and subject to operator error.

Of course, in a rather conventional grinding apparatus the operator could manually load and unload the workpiece carrier and also index the parts manually. Such an apparatus would be very expensive in labor and subject to operator error as well as being limited in the speed of operation.

Accordingly, the prior art grinding apparatus for such workpieces on two sets of transverse sides have disadvantages and imitations, in terms of cost and labor requirements.

SUMMARY OF THE INVENTION

The present invention overcomes the limitations and disadvantages of the prior art apparatus by providing a method of handling a workpiece in grinding apparatus having an improved workpiece handling accessory. The accessory provides simple and automated workpiece handling to minimizes the need for operator loading, unloading or indexing of workpieces. The present invention is a more automatic system requiring less operator skill and attention (and lower labor cost) in producing finished parts without operator error possibilities.

In manufacturing such workpieces in high volume i.e., for automotive applications, it is desirable to reduce to a minimum the amount of operator time and effort and maximize the amount of automated (without operator) operations.

The present invention also has the advantage that it is a simple and easily implemented accessory for a grinding apparatus that centralizes the workpiece handling function.

The present invention has the further advantage that handling of parts for indexing of partially ground parts or workpieces occurs simultaneously with the loading-/unloading of unfinished/completely finished workpieces. This simultaneous handling of diverse types of parts, which are handled differently but automatically, adds to the efficiency and simplicity of the apparatus disclosed herein.

Another advantage of the present invention is to provide an apparatus which eliminates the requirement for an operator to load a workpiece into workpiece carrier for grinding and to unload the workpiece from the workpiece carrier when the workpiece has been completely ground.

A further advantage is that the apparatus disclosed herein automatically selects workpieces which are completely finished for discharge and workpieces which are partially finished for indexing, without the necessity of an operator examining the workpiece to determine the state of a workpiece grinding and whether it should be indexed or discharged.

Another advantageous effect of the present invention is that raw (unground) workpieces may be stacked in a queue from which the apparatus automatically and without operator input advances a workpiece into the carrier at an appropriate time. Such a system eliminates the need for a separate machine operator and allows one operator to operate several machines simultaneously.

A further advantage is that there are relatively few moving parts and that the operation of such parts is simple and straight forward.

Other objects and advantages of the present invention will be apparant to one skilled in the art in view of the following detailed description of the preferred embodiment and the appended claims.

BRIEF DESCRIPTION OF THE DRAWINGS

FIG. 7 is a view of one portion of a workpiece carrier used in the grinding apparatus of the present invention.

FIG. 8 is a cross-sectional view of the workpiece carrier, taken along the line VIII—VIII in FIG. 7, looking in the direction of the arrows.

DETAILED DESCRIPTION OF THE DRAWINGS

Figure 1:
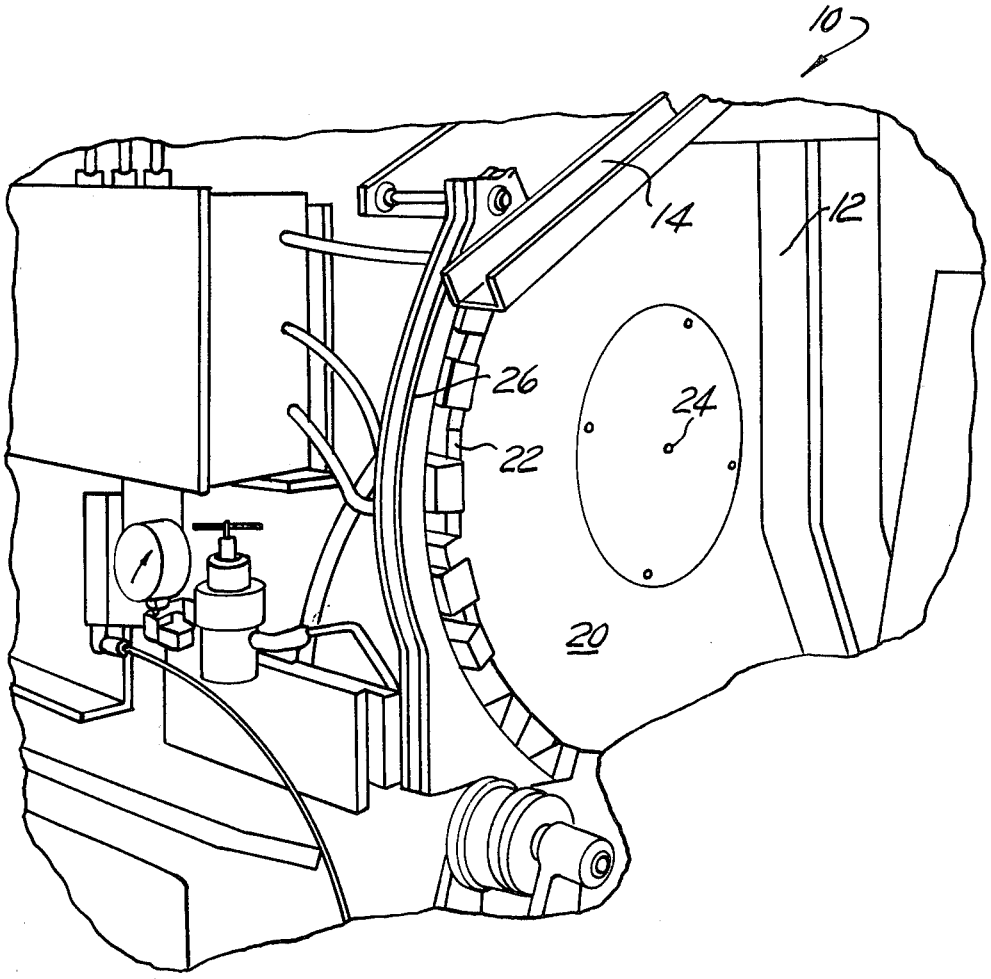
FIG. 1 is partial front and right side perspective view of a grinding apparatus of the present invention.

A portion of a grinding apparatus 10 of a preferred embodiment of the present invention is shown in its front and right side perspective view in FIG. 1. The grinding apparatus 10, only a part of which is shown in this view, includes two hidden grinding discs, vertically mounted and horizontally fed, spaced apart to define a grinding zone therebetween. The discs, their feed mechanism and the grinding zone are not shown in this view as they are hidden behind a guard 12 and a rotary workpiece carrier 20. These discs, rotary carrier, and feed mechanism are well known in the prior art and a typical example is described in some detail in various patents, such as U.S. Pat. No. 2,990,659 which is hereby specifically incorporated herein by reference for a better understanding of the grinding apparatus of the present invention.

The grinding apparatus 10 includes the workpiece carrier 20 which has pockets (formed by v-blocks 22). Each pocket 22 is designed and manufactured in a shape to receive and retain a workpiece (not shown) and carry the workpiece into the grinding zone from a loading station as the carrier 20 rotates about its central, generally horizontal axis 24. The rotation of the carrier 20 through the grinding zone moves the workpiece into contact with the grinding discs, grinding ends of the workpiece which extend laterally beyond the lateral edges of the workpiece carrier 20.

Suitable belts or other retainers hold the workpieces adjacent the pockets of the carrier against forces of gravity and grinding forces which may be applied to the workpieces at various locations during a rotation of the carrier 20. A retainer in the form of a solid front piece 26 prevents the workpieces from coming out of the carrier 20. The grinding apparatus also includes suitable other guards for protecting the operator from injury from contact with the rotating discs or debris from grinding.

A discharge chute 14 for completed workpieces is shown in FIG. 1, and its function will be more fully explained later in connection with other FIGURES.

Figure 2:
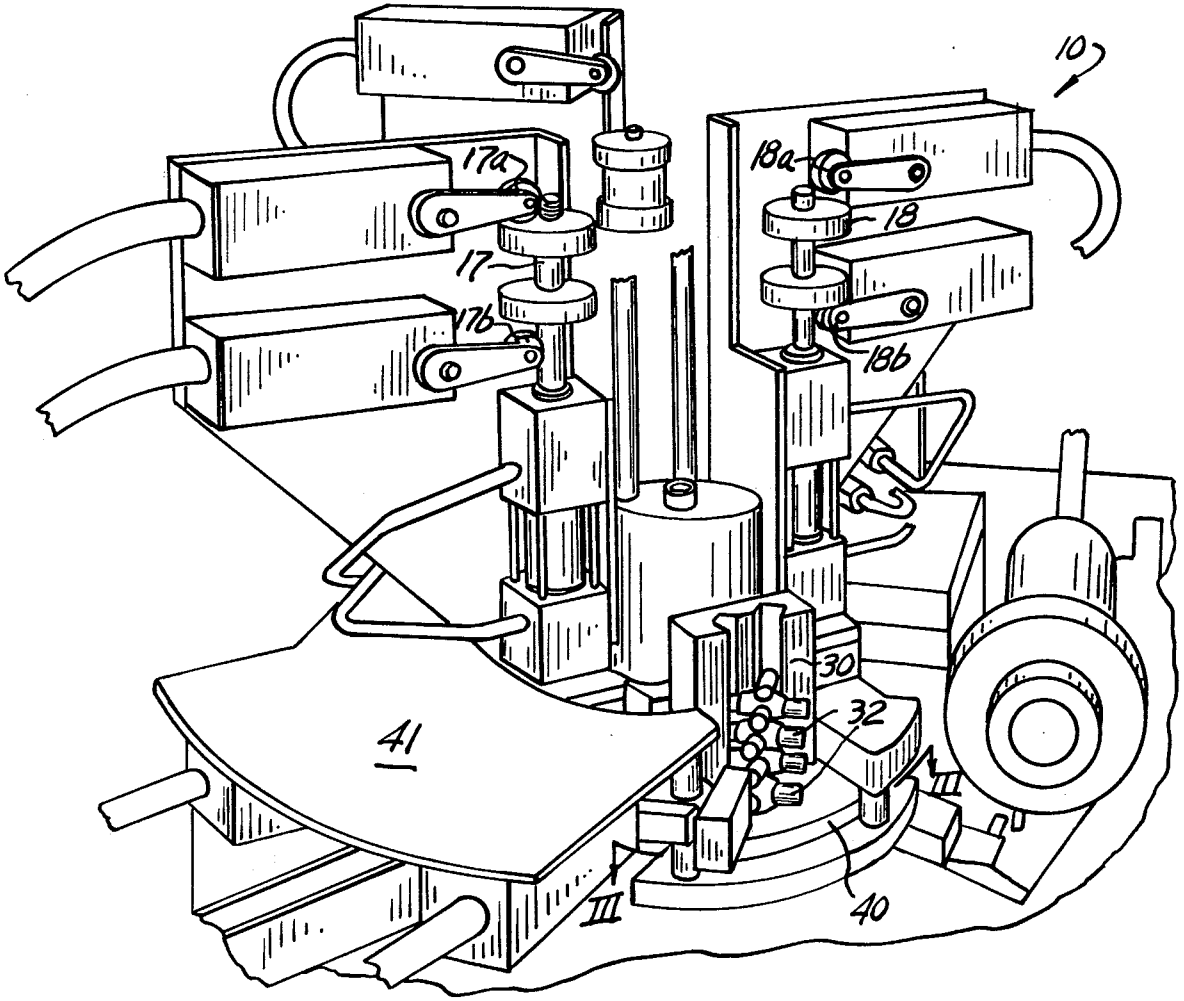
FIG. 2 is a top and side perspective view of the grinding apparatus of FIG. 1, showing a portion of the workpiece handling accessory of the present invention.

FIG. 2 shows, in perspective view, the upper portion of the grinding apparatus 10 of the present invention. A workpiece supply (a queue or magazine) 30 is shown with a stack of unground workpieces 32, along with a portion of a workpiece handling accessory 40, which will be shown more fully and explained in greater detail later, especially in connection with FIGS. 3–6.

The workpiece supply 30 comprises a plurality of workpieces 32 vertically stacked and arranged maintained in a uniform position and orientation until advanced toward the workpiece handling accessory 40 as will be explained later. Of course, other workpiece delivery and orienting configurations and structures could be easily substituted without affecting the present invention.

As shown in FIG. 2, reciprocating members 17, 18 are shown, with appropriate limit switches **17*a*, 17*b* and 18*a*, 18*b* for sensing the position of the reciprocating members 17 and 18, respectively. The reciprocating members 17, 18 function to move workpieces down out of the workpiece handling accessory 40 as will be explained in greater detail later. Also shown in this figure is a rotational position sensor assembly 41 for controlling the workpiece handling accessory 40**.

Figure 3:
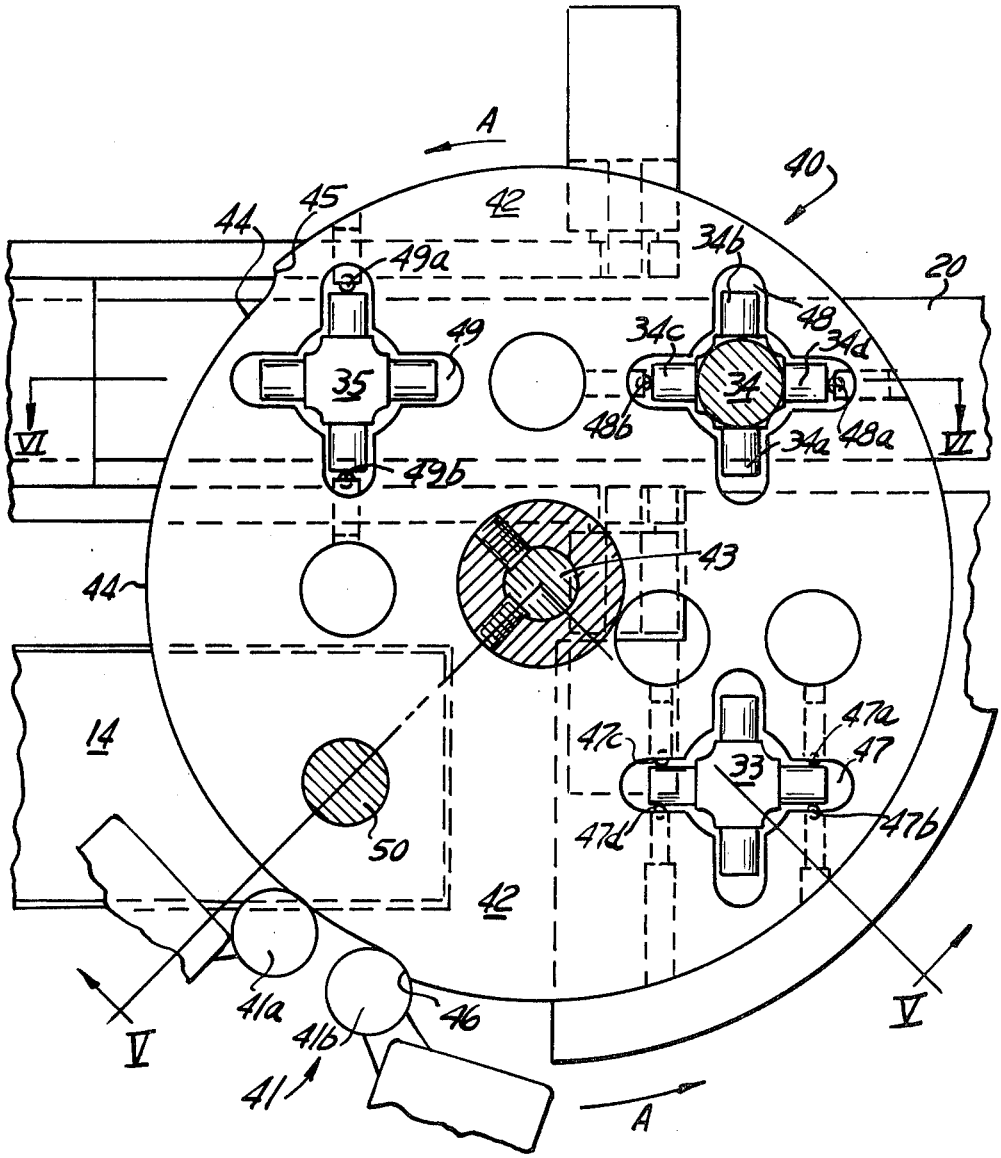
FIG. 3 is a partial top view of the grinding apparatus of FIG. 2, taken along the line III—III looking in the direction of the arrows, showing a portion of a workpiece handling accessory for the grinding apparatus.

FIG. 3 is a top view of the grinding apparatus and workpiece handling accessory of FIG. 2, taken from the line III—III in FIG. 2, looking in the direction of the arrows. Shown in this view are a top portion of workpiece carrier 20, the workpiece handling accessory 40, and the discharge chute 14 for completely finished workpieces.

The workpiece carrier 20 is mounted beneath the handling accessory 40, with only a portion of its rounded top edge being visible at either side of the handling accessory 40.

The workpiece handling accessory 40 includes the rotational position sensor 41 mentioned above and a plate-like member 42, rotatably mounted to a central axle 43 to allow the member 42 to reciprocally rotate approximately 90 degrees, alternatively in clockwise and counterclockwise directions, about the axle 43.

The plate-like member 42 is generally cylindrical, and is thin, only somewhat thicker than a workpiece, but has an arcuate sector 44 of a slightly smaller diameter between two end portions 45, 46. The two position sensing elements **41*a*, 41*b* associated with the rotation position sensor 41 control and limit the rotation of the plate member 42. The position sensing elements 41*a*, 41*b* are either mechanical or electrical sensors and cooperate with the end portions 45, 46 of the arcuate sector 44, and serve to limit or define the rotational displacement of the plate to substantially 90 degrees in the preferred embodiment. Electrical position sensors such as limit switches are coupled to a plate rotating motor control (not shown) coupled to the axle 43 to stop the rotation of the axle and the plate when a desired trigger position of the plate 42** has been reached.

The plate member 42 has three spaced apertures 47, 48, 49 for receiving and retaining workpieces therein for rotational displacement together with the plate member 42. The apertures are similar to the shape workpieces being handled, but larger than said workpieces. In this figure, workpieces 33, 34, 35 are associated with and positioned within the apertures 47, 48, 49 respectively.

Associated with each of said apertures are sets of opposed, spring-loaded workpiece retainers. The aperture 47 has two pairs of such retainers 47*a*, 47*b*, 47*c*, 47*d*. The aperture 48 has a pair of retainers 48*a*, 48*b*. The aperture 49 has a pair of retainers 49*a*, 49*b*. The retainers (e.g. 47*a*, etc.) are mounted within the plate member 42 and serve to hold the workpieces within the plate member 42 against undesired gravity forces, which would otherwise move workpieces down under the substantially horizontal plane shown in FIG. 3.

The stack or queue of workpieces is positioned directly above the aperture 47 and a workpiece is loaded into the aperture 47 of the plate member 43 by gravity when the aperture 47 is underneath the stack and the aperture 47 is empty.

The apertures 48, 49 are positioned directly above the workpiece carrier 20 to exchange workpieces onto and/or off of the carrier 20 as will be explained in greater detail later in conjunction with the description of machine operation.

A small circular aperture 50 is directly above the finished part discharge chute 14. The aperture 50 is smaller than a workpiece so that it will not admit a workpiece therein.

In the FIG. 3 position of the plate member 42 an unground workpiece from the workpiece magazine has just been moved into the previously-empty aperture 47. A workpiece on which two opposite legs 34*a*, 34*b* have been ground (but two legs 34*c*, 34*d* are unground) has just been moved from the carrier 20 up into the plate member 42 into the previously empty aperture 48. A workpiece 35 on which all four legs have been ground has also just been moved up from the carrier 20 into the previously empty aperture 49. Of course, during machine start up or shut down, one or more of these workpieces positions (apertures) be empty initially and until the plate member 42 is fully loaded. An empty position does not affect the other machine operations or workpieces being moved.

Figure 4:
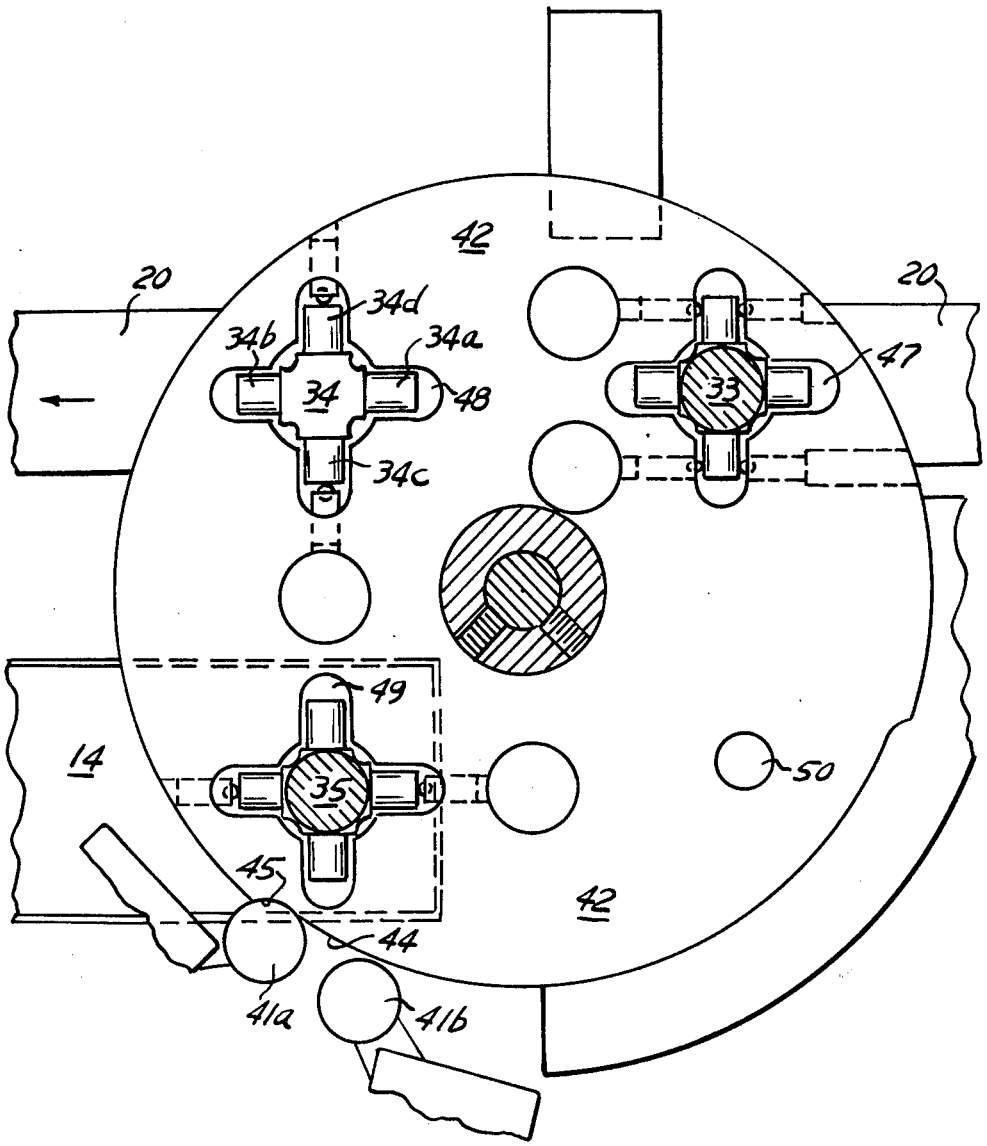
FIG. 4 is a partial top view of the workpiece handling accessory of FIG. 3 after it has been indexed by 90 degrees from its FIG. 3 position.

FIG. 3 includes arrows A which indicate the direction of rotation (counterclockwise in this view) about the axle 43 which is undertaken to advance the plate member 42 to its FIG. 4 position from its position as shown in FIG. 3.

The top of the workpiece carrier 20 moves from right to left in FIG. 3 as it rotates to advance workpieces into the grinding zone. Therefore, the portion of the carrier 20 under aperture 49 is closer to the grinding zone than the portion under the aperture 48.

FIG. 4 is a view of the apparatus of FIG. 3 with the plate-like member 42 rotated 90° counterclockwise. As shown in FIG. 4, the apertures 47 and 48 are above the workpiece carrier 20 (where the apertures 48 and 49, respectively, had been in FIG. 3). The aperture 49 is now where the aperture 50 had been in FIG. 3, namely, above the discharge chute 14. The small circular aperture 50, which is still not large enough to admit a workpiece, is directly below the raw (unground) workpiece magazine, but a raw workpiece cannot advance due to the lack of a suitability sized aperture.

The position sensor 41*a*, engaging the end 45 of the segment 44, controls the rotational position of the plate member 42, and limits its rotation to approximately 90° from its FIG. 3 to FIG. 4 position.

In the FIG. 4 position, the unground (raw) workpiece 33 in the aperture 47 is now above the workpiece carrier. The workpiece 34 with two ground legs 34*a*, 34*b* and two unground legs 34*c*, 34*d* is in the aperture 48 and is now above the workpiece carrier 20, which has moved in the direction of the advance of the carrier 20 toward the grinding zone and timed so that the workpiece 34 may be placed into the very same pocket of the carrier from which it was removed, but which has meanwhile advanced a portion of a revolution (from beneath the aperture 48 to beneath the aperture 49 in FIG. 3).

Figure 5:
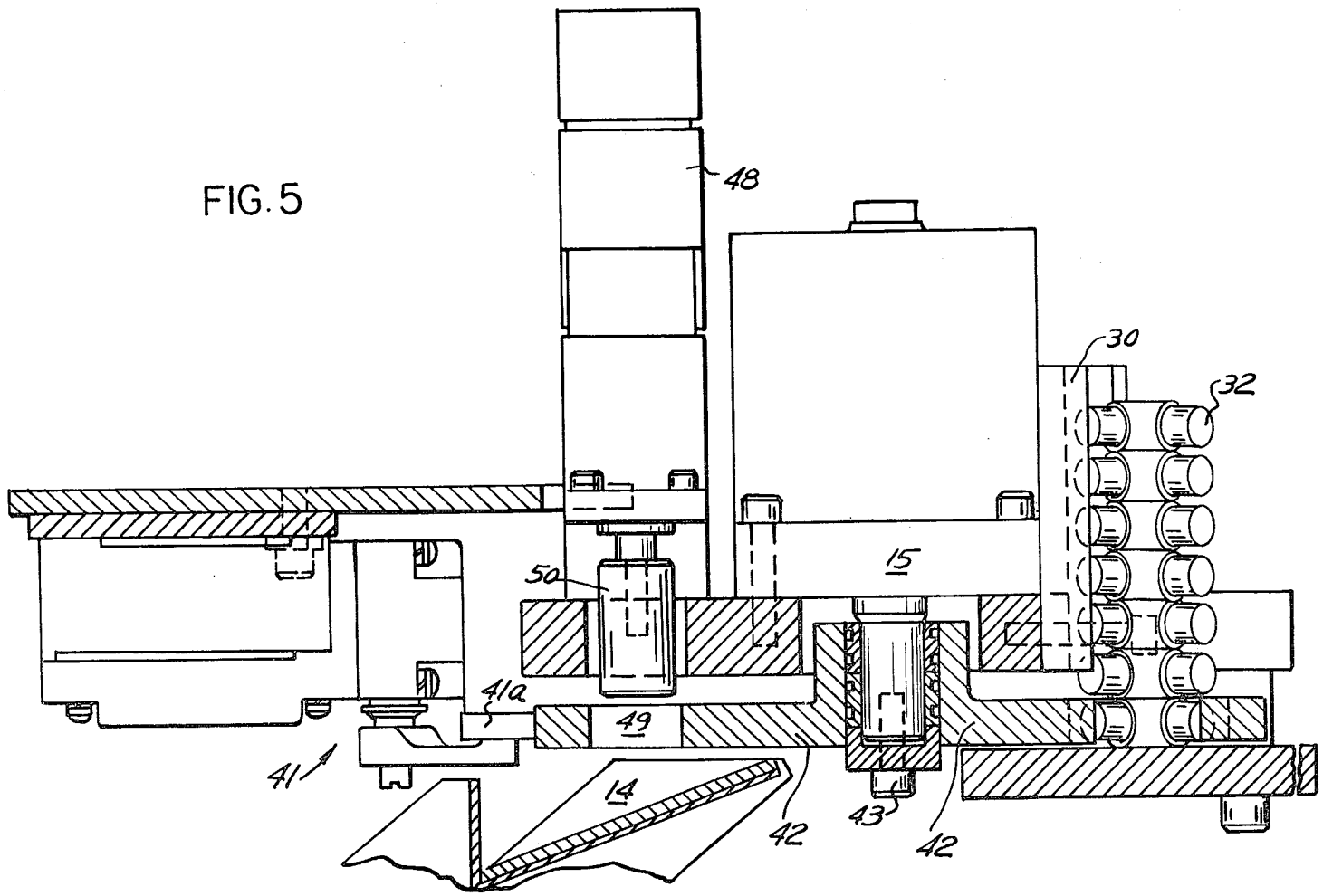
FIG. 5 is a cross-sectional view of the grinding apparatus and workpiece handling accessory, taken along the line V—V in FIG. 3, looking in the direction of the arrows.

FIG. 5 is a side cross-sectional view of the grinding apparatus 10 of the present invention, taken along the line V—V in FIG. 3. The plate-like member 42 and its central axle 43 mounting it to a machine frame 15 are shown, with the workpiece magazine 30 and a stack of workpieces 32. A position of rotational position sensor 41 is shown with its sensing element 41*a*.

A cylinder 48 having a pusher member 50 operates to move a workpiece from aperture 49 into the discharge chute 14.

Figure 6:
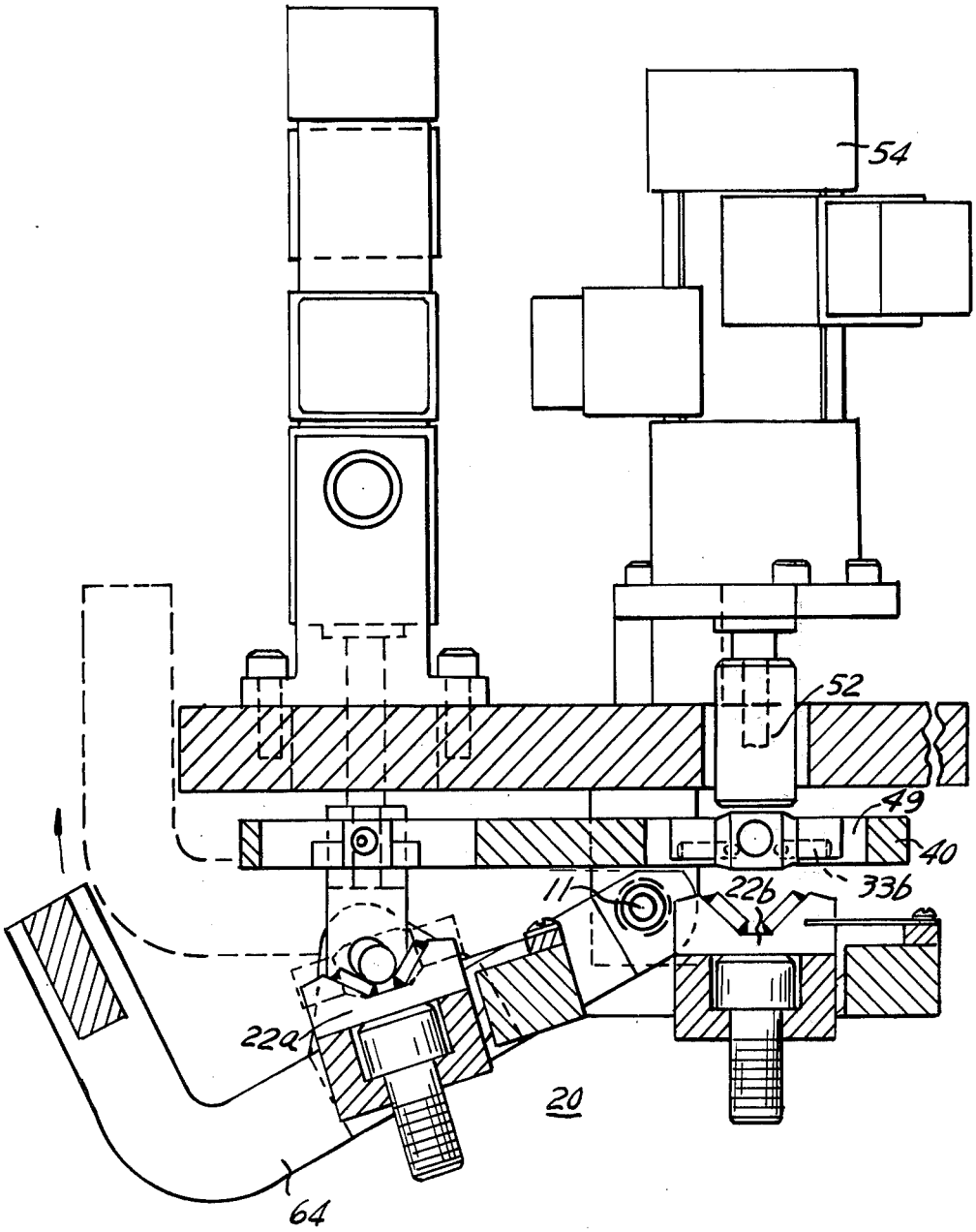
FIG. 6 is a cross-sectional view of the grinding apparatus and workpiece handling accessory, taken along the line VI—VI in FIG. 3, looking in the direction of the arrows.

FIG. 6 is a cross-sectional view showing the workpiece handling accessory 40 and the workpiece carrier 20.

The workpiece carrier 20 includes the workpiece pockets (formed by V-blocks) 22 spaced at regular intervals peripherally around the cylindrical workpiece carrier. There are an odd number of such workpiece pockets 22 (e.g., 21 in the preferred embodiment), to provide for selection of appropriate workpieces by the workpiece handling accessory. Every other part is identical (e.g., fully ground), while the intervening parts are identical to one another (e.g. partially ground—calling for different handling (fully ground for discharge, partially ground for indexing) by the workpiece handling accessory 40.

A push down member 52 is mounted above the aperture 49 to move a part 33*b* down from the accessory 40 (e.g. out of the workpiece retainers) and into the pocket 22*b*. A cylinder 54 with limit switches and position sensors (as is well known and appropriate) operates the push down member 52 and is also mounted to the apparatus frame.

A lifting arm 64 is pivotally mounted at 11 to the frame of the apparatus 10 and movable by a cylinder 60 to lift a partially ground workpiece 34 from a workpiece pocket 22*a* and into the aperture 48 of the workpiece handling accessory 40. The lifting arm 64 preferably includes two fingers, one for engaging each exposed (overhanging) leg of the workpiece extending outwardly of the carrier 20, the same exposed or overhanging legs which are ground.

A lifting apparatus (not shown) similar to the lifting arm and cylinder are provided in the region of the pocket 22*b* to enable a fully ground part to be moved to the discharge chute (not shown). A similar push down apparatus is also employed to move the unground (raw) workpiece into the rotary carrier for the first time.

FIG. 7 shows an enlarged view of the pocket 22 of the rotary carrier 30 is shown with a workpiece 36 carried therein. The pocket 22 includes two sets of V-blocks 22*a*, 22*b* which coverage to form a through into which the workpiece legs 36*a*, 36*c* sit. The two intermediate legs 36*b*, 36*d* are aligned with the rotary carrier, generally aligned with the rotation of the carrier as evidenced by an arrow. The two overhanging legs 36*a*, 36*c* terminate in faces 36*e*, 36*f*, respectively, which are ground during rotation of the carrier.

FIG. 8 shows another view of the pocket 22 with the V block formed by members 22*a*, 22*b* carrying the workpiece 36, with legs 36*b* and 36*d* shown and the face 36*e* to be ground.

Machine Operation

Although most of the operation of the grinding machine of the present invention will occur while workpieces are in varying stages of completion, an explanation of machine operational start-up is probably the most easily understood, and from this, continuing operation and machine shut down can easily be comprehended by expansion of the operating principles.

Initially, the workpiece carrier 20 is empty and unground (rough) workpieces are stacked in the magazine or workpiece supply 30 (FIG. 2). The plate member 42, also initially empty of workpieces, reaches its FIG. 3 position where a first rough workpiece is loaded into the aperture 47 by gravity and retained by spring retainers 47*a*, 47*b*, 47*c*, 47*d*.

The plate member 42 then rotates 90 degrees from its FIG. 3 position to its FIG. 4 position. The rotation is controlled by the sensing element 41*a* and the edge 45. There, the aperture 47 is positioned above the workpiece carrier 20.

There, at the FIG. 4 position, a push down cylinder member moves the rough workpiece down into a pocket of the rotary carrier, which rotates clockwise in FIG. 6 to grind the rough workpiece on the first two opposing legs, the legs which extend perpendicular to the plane of FIG. 6 sheet and which extend laterally outside of the carrier 30.

Once the first two legs of the workpiece have been ground, the carrier 20 continues to rotate until the pocket carrying the part reaches a position adjacent the lifting arm 64 of FIG. 6.

There, the lifting arm 64 raises the workpiece into the handling accessory 40 (aperture 48) in its FIG. 3 position. The accessory 40 is then rotated (while the carrier 20 rotates) to its FIG. 4 position where a push down cylinder reloads the workpiece (reoriented by 90 degrees) into the carrier, particularly back into the same pocket rotated (or advanced) to below the FIG. 4 position of aperture 48.

The rotary carrier then carries the reoriented workpiece back through the grind region to grind the other two legs.

When the by-now completely ground workpiece now reaches a position beneath the aperture 49 in its FIG. 3 position above the carrier 20, the workpiece is lifted into the aperture 49 and the accessory 40 rotates to its FIG. 4 position. The finished workpiece is then pushed down into the discharge chute.

Many modifications of the present invention will be apparent to those skilled in the art. Some features of the present invention may also be used without the corresponding use of other features. For examples, the workpiece handling accessory described in the preceding pages may be used without workpiece retainers if the workpieces do not become dislodged. Also, other workpiece feed and discharge arrangements (conveyors, article handling apparatus, bowl feeders) could be used to advantage without departing from the spirit of the present invention. Thus, the foregoing description should be taken as merely illustrative of the present invention, and not in limitation thereof, which is defined solely by the following claims.

Having thus described the invention, what is claimed is:

1. A method of grinding a workpiece using a grinding apparatus of the type having a frame, a movable grinding member coupled to the frame for grinding a surface of workpiece at a grinding station, a carrier movably coupled to said frame having a loading station and an unloading station and a workpiece-handling apparatus coupled to the frame adjacent to the carrier and having at least two workpiece receiving apertures for receiving a workpiece at the unloading station and for loading workpieces into and discharging workpieces from the carrier, the steps of the method comprising:
   - positioning a workpiece adjacent one of the workpiece-receiving apertures of the workpiece-handling apparatus;
   - loading the workpiece from the carrier into the adjacent aperture;
   - rotating the workpiece-handling apparatus through a partial revolution to move the one aperture adjacent to a loading station of the carrier;
   - moving the workpiece from the apparatus to the carrier;
   - moving the carrier to bring a first surface of the workpiece adjacent the grinding member at the grinding station grinding the workpiece with the grinding member;
   - moving the carrier to bring the workpiece to the unloadng station;
   - moving the workpiece from the carrier of the unloading station to an aperture of the workpiece-handling apparatus;
   - rotating the workpiece-handling apparatus through a partial revolution in a plane to an unload station adjacent the carrier to expose another surface;
   - reloading the workpiece into the carrier;
   - grinding the other surface; and
   - unloading and discharging the workpiece.

2. A method of the type described in claim 1 wherein the steps of reloading the workpiece includes replacing it in the same aperture of the carrier from which it had been removed.

3. A method of the type described in claim 1 wherein the steps of moving one workpiece to loading station occurs simultaneously with the unloading and discharging of a second workpiece.

4. A method of the type described in claim 3 wherein the unloading and discharging of the workpiece include moving the workpiece into the workpiece handling apparatus and rotating it to a discharge chute where the workpiece is discharged.

5. A method of grinding a workpiece using a disc grinder of the type having a frame, a rotatable disc grinding member for grinding a surface of the workpiece at a grinding station, a carrier for moving a workpiece from a loading station to the grinding station where grinding a workpiece surface adjacent the disc grinding member occurs, said carrier further moving a workpiece to an unloading station after grinding, the improvement wherein the steps of the method comprised:

moving a workpiece from a source of unground parts to a position adjacent to the carrier through the use of a plate member rotating in a single plane;

moving the unground workpiece from the plate member to an aperture in the carrier;

after a grinding operation, removing the workpiece having a ground surface from the carrier to the plate member;

rotating the plate member a partial revolution in its common plane to reorient the workpiece;

removing the workpiece from the plate member to the carrier in its reoriented position having a different surface to be ground;

after a second grinding operation on a second surface, removing the workpiece from the carrier; and discharging the workpiece.

6. A method of grinding a workpiece including the steps of claim 5 in which the step of discharging the workpiece includes the steps of moving the workpiece from the carrier to the plate member and rotating the plate member to position the workpiece to be discharged above a discharge chute, then moving the workpiece into the discharge chute.

7. A method of grinding workpieces including the steps specified in the claim 6 wherein the step of moving a workpiece to the discharge chute occurs simultaneously with moving a second workpiece from a loading chute to a position above the carrier for loading.

8. A method of grinding workpieces as specified in claim 5 in which the plate member is a cylindrical flat plate-like member having a drive for rotating it about its axis and including apertures extending therethrough with means for retaining a workpiece therein against gravity forces during rotation, and the steps of the method further include positioning the workpiece within the retaining means before moving it from the source of unground parts, removing it from the retaining means after movement, repositioning it within the retaining means after the first grinding operation and the steps of moving the workpiece through rotation of the plate member occur while the workpiece is retained in the retaining means.

* * * * *